United States Patent [19]

Enix

[11] Patent Number: 4,904,100

[45] Date of Patent: Feb. 27, 1990

[54] CARTRIDGE AND PRINTER SYSTEM FOR USING ROLL PRINT MEDIA

[75] Inventor: Bruce W. Enix, Huber Heights, Ohio

[73] Assignee: Eastman Kodak Company, Rochester, N.Y.

[21] Appl. No.: 280,084

[22] Filed: Dec. 5, 1988

[51] Int. Cl.[4] ..... B41J 15/04

[52] U.S. Cl. ..... 400/613; 400/693; 400/717; 242/197

[58] Field of Search ..... 400/613, 88, 613.1, 400/126, 693, 207, 693.1, 694, 208, 717, 718; 242/197, 200

[56] References Cited

U.S. PATENT DOCUMENTS

| | | | |
|---|---|---|---|
| 1,730,445 | 10/1926 | Barney | 400/541 |
| 2,825,450 | 3/1958 | Lambert | 400/208 |
| 3,476,230 | 11/1969 | Hunter | 400/600 |
| 3,539,276 | 10/1970 | Bundschuh et al. | 242/197 |
| 3,545,004 | 12/1970 | Alden | 400/613 |
| 3,627,225 | 12/1971 | Badum et al. | 242/197 |
| 3,762,529 | 10/1973 | Griffith | 400/718 |
| 3,908,810 | 9/1975 | Denley | 400/613 |
| 3,939,956 | 2/1976 | Stamou | 400/613 |
| 4,372,694 | 2/1983 | Bovio et al. | 400/613.1 |
| 4,522,521 | 6/1985 | Scott | 400/691 |
| 4,754,875 | 7/1988 | Rauffer | 242/197 |
| 4,764,041 | 8/1988 | Bierhoff | 400/613 |

FOREIGN PATENT DOCUMENTS

| | | | |
|---|---|---|---|
| 3728220 | 2/1988 | Fed. Rep. of Germany | 400/613 |
| 124677 | 9/1980 | Japan | 400/613 |
| 101883 | 8/1981 | Japan | 400/613 |
| 152981 | 9/1982 | Japan | 400/613 |
| 128886 | 8/1983 | Japan | 400/613 |
| 254371 | 11/1986 | Japan | 400/613 |

*Primary Examiner*—William Pieprz
*Attorney, Agent, or Firm*—John D. Husser

[57] ABSTRACT

A print media cartridge for use in combination with a portable printer having a housing with a print media ingress in its lower rear wall and a print media egress in its top wall. The cartridge includes a housing having an elongated wall portion of generally U-shape cross section and two end wall portions closing the ends of the elongated portion, a roll of print media supported within the elongated wall portion with roll ends facing respective end wall portions; and a cartridge door of size and shape corresponding to the open side of the elongated U-shaped wall portion. The door is hingedly coupled to one lip of the elongated U-shaped portion and there are means for latching the door to the other lip of the elongated, U-shaped wall portion.

5 Claims, 5 Drawing Sheets

CARTRIDGE AND PRINTER SYSTEM FOR USING ROLL PRINT MEDIA

FIELD OF INVENTION

The present invention relates to small printers, e.g., for producing printout for portable computers, and more specifically to a system wherein a roll paper cartridge is constructed for simple, interfitting cooperation with a portable printer.

BACKGROUND ART

U.S. Pat. No. 4,759,646 discloses a small, ink jet printer wherein print media is advanced line-by-line through a print zone by a rotary platen and a print head carriage traverses the print zone to print on successively advanced lines. This printer is designed for easy portability and achieves enhanced compactness by incorporating battery power sources within the platen.

U.S. patent application Ser. No. 185,340, filed Apr. 12, 1988, describes a portable printer construction for handling three different types of print media, viz: sheet print media, continuous print media with tractor-feed perforation edges and continuous print media without edge perforations. The continuous print media can be provided in either roll or fanfold formats. The tractor-feed continuous media usually is in the fanfold format and has the advantage of providing controlled feeding, without skew. The roll format media can be utilized without edge perforations and is compact and convenient to carry in a briefcase.

The printer described in the Ser. No. 185,340 application has a lid construction that fully opens to prevent re-feed in the fanfold print mode. In the roll media print mode, the lid is closed and has a guide slot, which contacts media edges, to prevent media skewing. This printer configuration is highly useful, but presents one difficulty. Thus, in the mode using non-perforated, continuous print media, the lid (and its guide slot) are required in the closed condition to prevent skew. Therefore the lid cannot protect against re-feeding the lead end into the media ingress in the rear of the printer, as it does in the fully open condition.

SUMMARY OF THE INVENTION

One important purpose of the present invention is to provide a printer system (including printer and media cartridge) that enables more reliable use of continuous, non-perforated print media with small printers, e.g. such as described in the Ser. No. 185,340 application. The invention cartridge provides a handy container of roll print media, which closes for portage or storage and opens to interfit with the printer in a manner that aids in guiding media input and prevents media re-feed.

In one aspect the present invention constitutes a print media cartridge for use with a portable printer having a housing with a print media ingress in its lower rear wall and a print media egress in its top wall. The cartridge includes: (a) a cartridge housing having an elongated wall portion of generally U-shape cross section and two end wall portions closing the ends of the elongated portion; (b) a roll of print media supported within the elongated wall portion with roll ends facing respective end wall portions; (c) a cartridge door of size and shape corresponding to the open side of the elongated, U-shaped wall portion; (d) a hinge(s) for coupling the cartridge door to one lip of the elongated U-shaped portion; and (e) means for latching the door to the other lip of the elongated, U-shaped wall portion.

In another aspect the invention constitutes a system wherein such printer and cartridge cooperate in supplying and guiding print media through the printing process.

BRIEF DESCRIPTION OF THE DRAWINGS

The subsequent description of preferred embodiments refers to the accompanying drawings wherein.

DETAILED DESCRIPTION OF THE PREFERRED EMBODIMENTS

Figure 1:
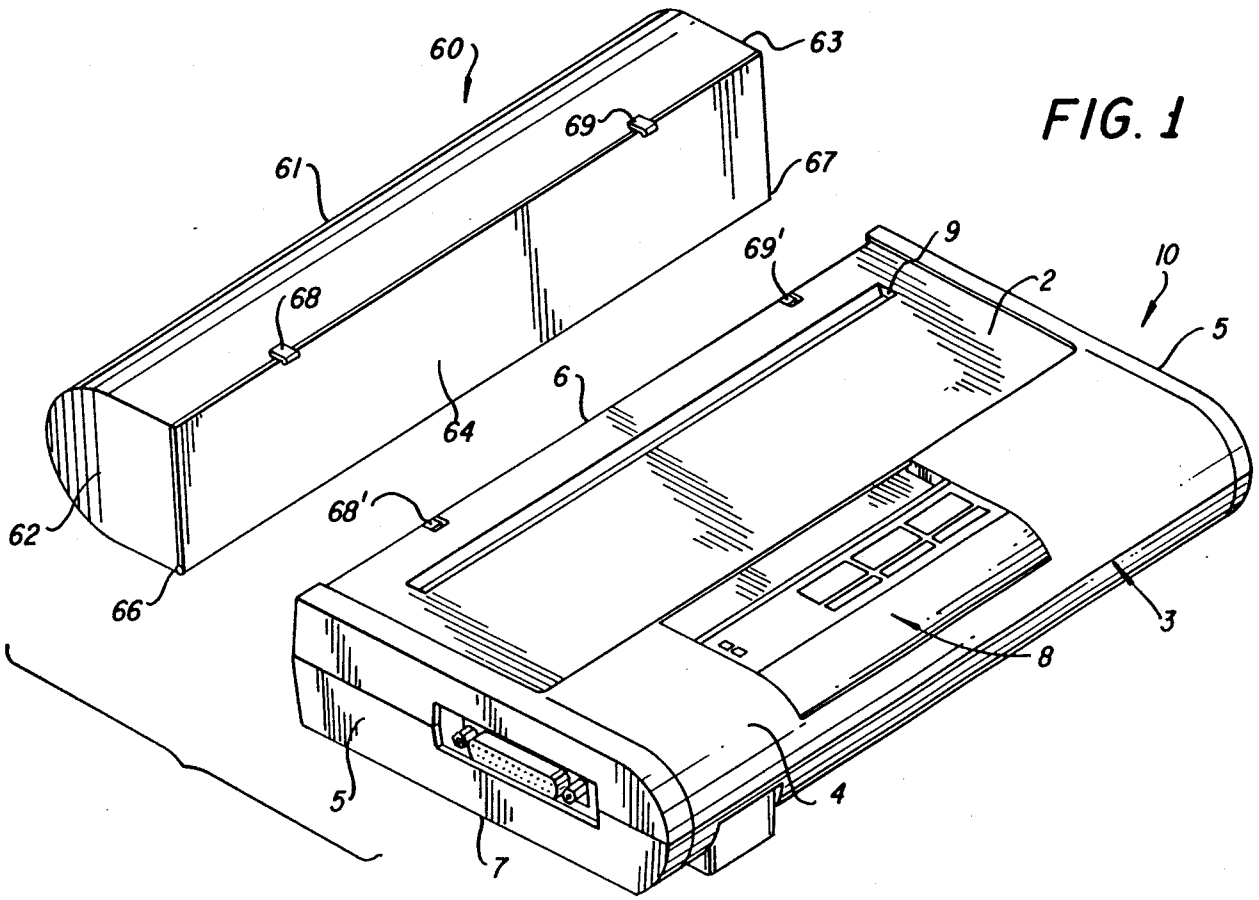
FIG. 1 is a perspective view of one preferred printer of the printer/cartridge system according to the present invention with the cartridge and printer in closed condition.
Figure 2:
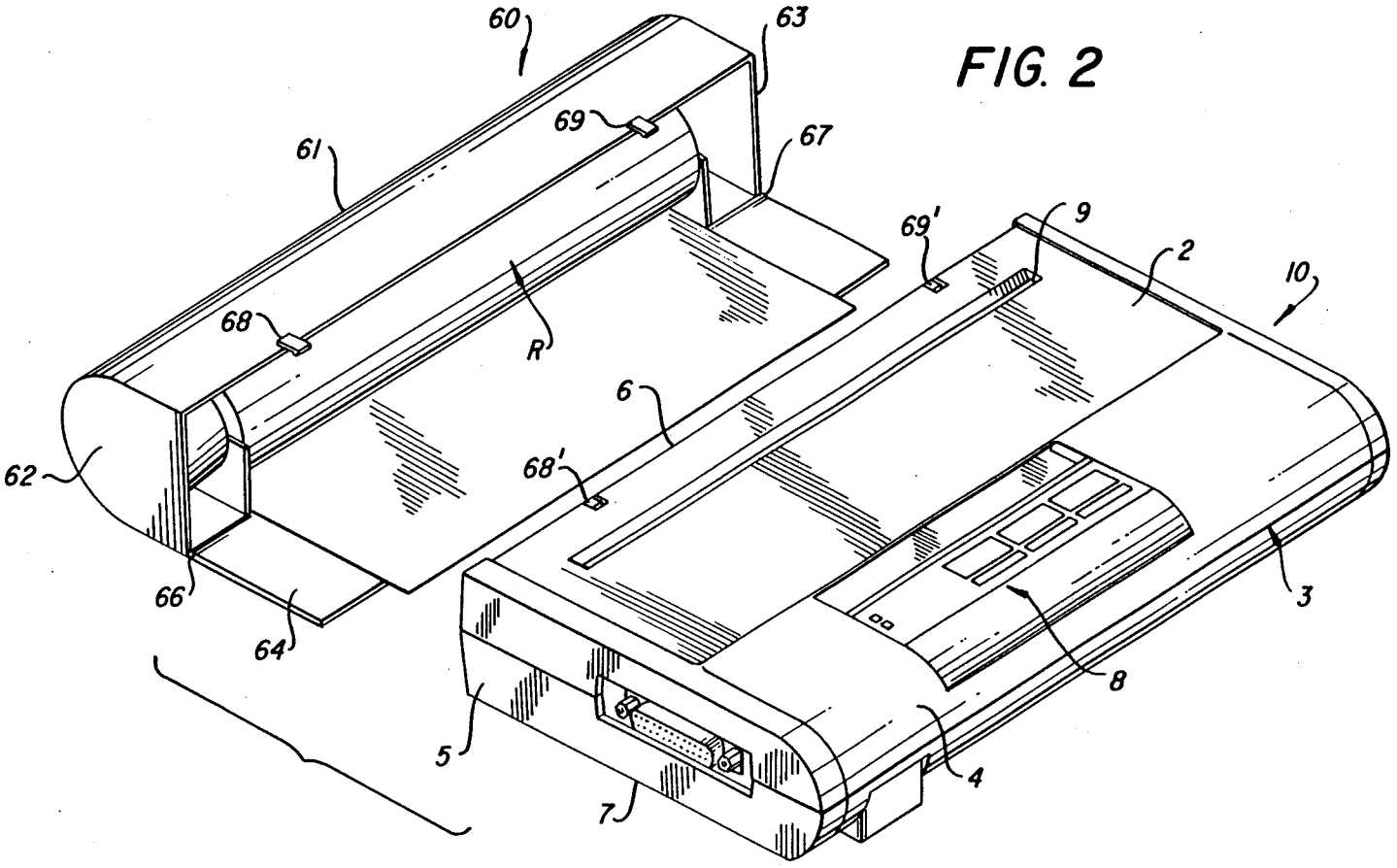
FIG. 2 is a perspective view of the FIG. 1 printer/-cartridge system with the cartridge open and ready for engagement with the printer.
Figure 3:
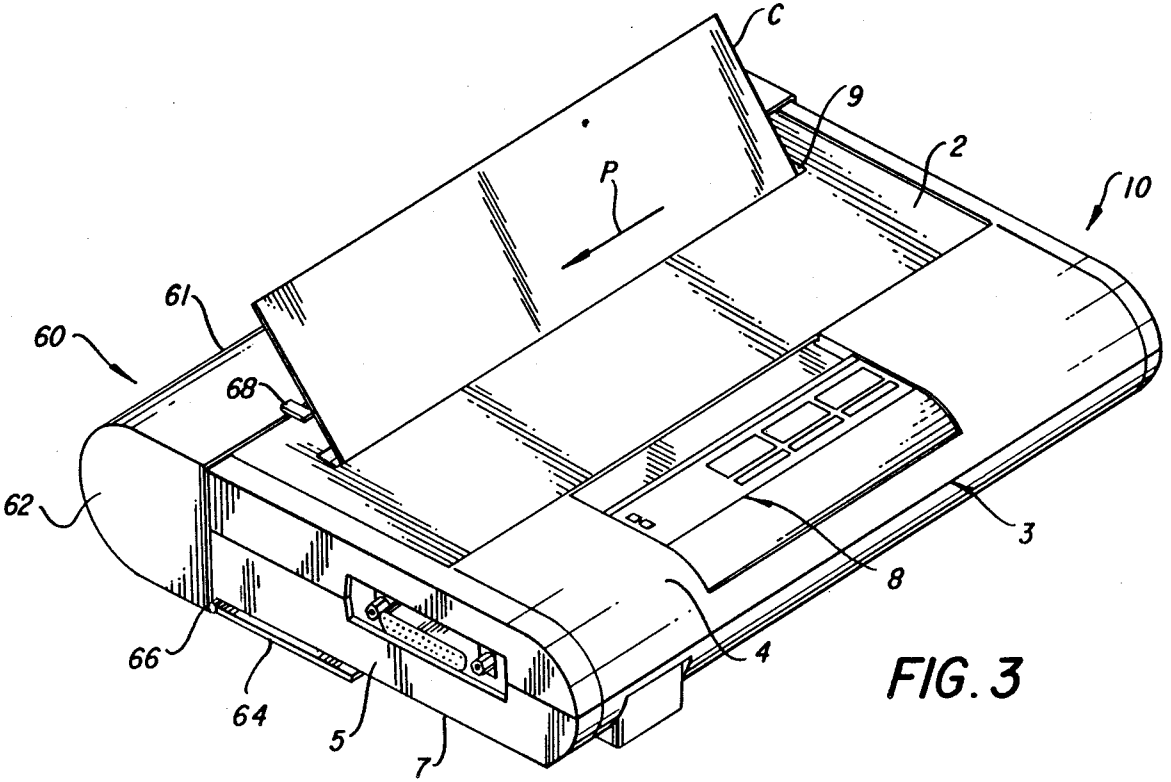
FIG. 3 is a perspective view of the FIGS. 2 and 3 system with the cartridge engaged with the printer.

FIGS. 1–3 illustrate one preferred embodiment of portable printer 10 and roll media cartridge 60 in accord with the system of the present invention. The printer 10 has a top lid member 2, which in FIG. 1 is in a closed position. The printer also comprises a front wall portion 3, a top wall portion 4, side wall portions 5, a rear wall portion 6 and a bottom wall portion 7. The printer front includes a control panel 8 and the lid 2 has a slot 9 for purposes that are described subsequently.

Figure 5:
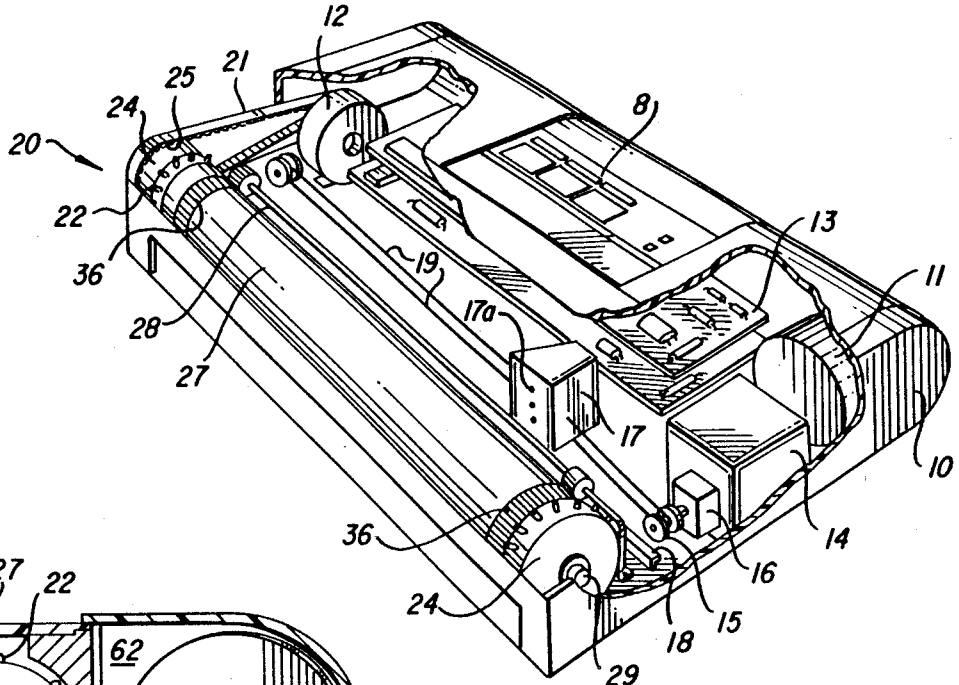
FIG. 5 is a perspective view of the FIG. 1 printer, with housing portions broken away to show portions of the printer interior.

FIG. 5 shows the exemplary printer embodiment 10 with lid and wall portions removed. Within printer 10 are mounted print head motor 11, platen motor 12, and printing and drive control circuit boards 13. The motor 11 is coupled via a gear reduction drive (shown generally as 14) to a cable drive spindle 15 housed in journal 16. Rotation of motor 11 traverses print head assembly 17 along its support bar 18 by virtue of its coupling to one strand of endless drive cable 19. Motor 12 is coupled to the print media transport system 20 by gear means, e.g. a gear train or geared drive belt 21. The transport system 20 is described in greater detail below, however, in general it functions as print media advancing means to move print medium, e.g. paper, from a lower zone of the printer past the transversing printing path of the print head 17, which defines a printing zone, and to an upper printer zone wherefrom the media egress the printer. Thus, under control of circuits 13, portions of the print media, e.g. paper sheets or webs, are sequentially indexed and the print head traverses across the indexed portion to effect printing, e.g. by ejected ink drops, selective thermal heating or by impact printing. That is, the ink jet print head 17 (with its ejection orifices 17*a*) is only exemplary of various printing technologies with which the present invention is useful.

Referring further to FIG. 5, it can be seen that the printer comprises a rotatable platen 27 having thereon sprocket teeth 22 which are constructed for advancing tractor-fed paper types. The ends of the platen are coupled to end plates 24, one of which has a drive gear 25 adapted to mesh with gear means 21. Both of the platen end plates 24 have bearing surfaces adapted to support the platen for rotation on the journal surface of shafts 29 that extend from the inner side walls. A bail assembly 28 is mounted within the printer to engage friction surfaces 36 which are formed on portions of the platen periphery.

Figure 6:
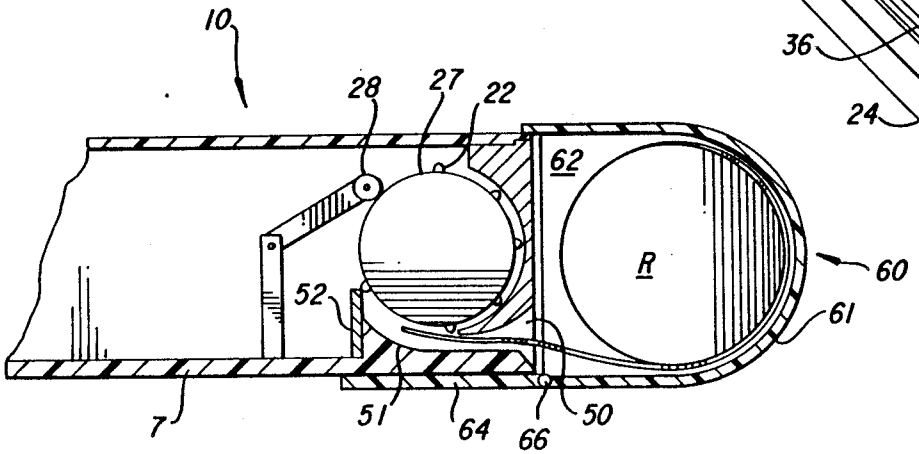
FIG. 6 is a cross section of a portion of the FIG. 1 printer with cartridge attached showing the print media path.

Referring now to FIGS. 5 and 6, it can be seen that the lower portion of rear wall 6 of printer 10 comprises a wide throated media ingress 50. As best seen in FIG. 6, the inner surface of the bottom wall 7 is formed with a raised arcuate surface 51 adapted to direct the leading edge of media, which has been inserted into ingress 50, upwardly toward the front of platen 27. A resilient member 52 can be affixed to the bottom wall 7 to further guide the leading media edge into proper relation with the printing zone of the apparatus. Bail 28 is provided to maintain upper portions of the print media in contact with portions 36 of platen 27, so that the media moves with the platen and egresses from the printer top.

FIG. 1 shows the printer 10 with its lid 2 in the orientation that is preferred for use with continuous print media, that is not perforated for tractor feed. Slot 9 is only slightly wider than such print media. In operation, the lid is first lifted to the first open position and the leading edge of the continuous print media is fed into ingress 50. Bail 28 is lifted and the leading media edge is fed through slot 9. The bail is next moved to its engaging position shown in FIG. 6 and the lid 2 is returned to the closed position as shown in FIGS. 1–3. If, during printing operation, the continuous print media begins to slip between the bail and platen, a skewed printing condition is prevented by the edges of slot 9 contacting the edge of the print medium, thus exerting a pressure, e.g. in the direction indicated by P in FIG. 3. Because the lid 2, in its closed position, is spaced closely to the bail wheels, the force P that prevents print media skewing is not great enough to crease the print media or cause a bind at the point of contact.

FIGS. 1–3 and 4 show the detailed construction of the print media cartridge 60, which is constructed to cooperate with the FIG. 1 printer in a manner forming a simple and reliable printer/cartridge system. The cartridge 60 comprises a housing that includes an elongated wall portion 61 of generally U-shape cross section and end wall portions 62, 63. The media cartridge 60 also includes a door member 64 that is sized and shaped to correspond to the opening of the U-shaped housing and is coupled by hinge members 66, 67 to the lower lip edge of the housing. Two resilient latch arms 68, 69 are affixed to the top lip edge of the housing and function to retain the door member in its closed position as shown in FIG. 2.

Figure 4:
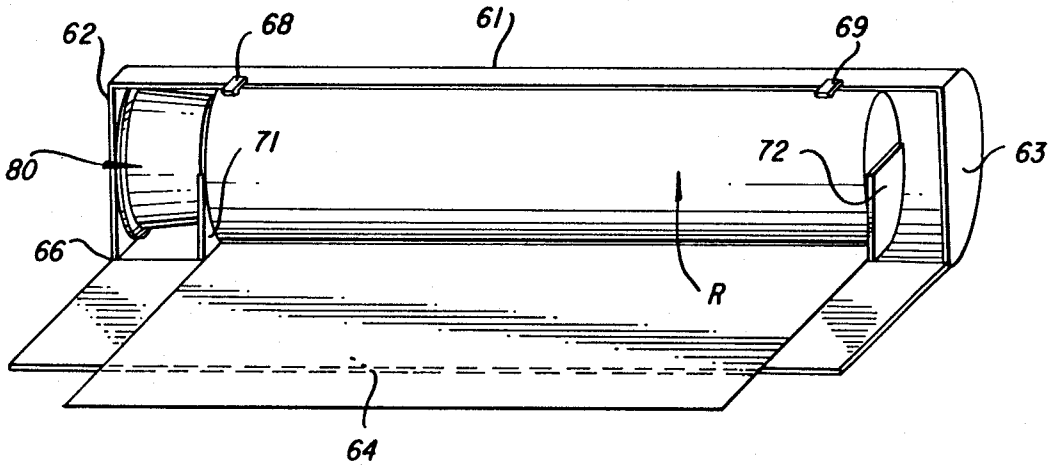
FIG. 4 is a perspective view of the FIG. 1 cartridge in an open condition.

FIGS. 2 and 4 shows the cartridge 60 in its open condition and it can be seen that two retainer walls 71, 72 mounted within the cartridge housing locate a roll R of print media, along the longitudinal housing axis, in a predetermined relation to end walls 62, 63. More specifically, it is preferable that end walls 62, 63 have the same spacing as the printer width and that retainer walls 71, 72 be located within the housing so that, when the cartridge end walls are aligned with the printer side walls, the roll R will be properly aligned with respect to its desired print path across printer platen 27. In the embodiment shown in FIGS. 2 and 4, the roll R is located slightly to the right of a centered position. This corresponds to the slight offset from center of the print path with respect to the overall printer width. In a preferred embodiment, a compartment 80 is provided between end wall 62 and retainer wall 71 and can be used to contain a spare print head element 17 for the printer 20.

Referring now to FIGS. 3 and 6, the way in which the cartridge 60 cooperates with printer 10 to effect printing with non-perforated, roll-type print media will be clear. Thus, the cartridge door 64 is opened and a lead end of the paper roll R is fed into the printer ingress path 50 in the bottom of the rear wall 6. The lead sheet end is pulled across the platen 27, under bail roller 28 and into alignment with, or through, the slot 9 in printer lid 2. The cartridge bottom wall 64 is placed on the printing site surface, e.g. a desk top, below the bottom wall 7 of the printer; and the ends 62, 63 of the cartridge are aligned with side wall 5 of the printer. Printing is now commenced and the print material is withdrawn as needed by the rotation of platen 27, at its pressure nip with bail roller 28.

As can be seen in FIG. 3, the top lip of the cartridge prevents the re-feed of print material, that exits slot 9, into the printer ingress opening 50. In a preferred embodiment, the latch members 68, 69 detent into recesses 68', 69' formed in the rear edge of the lid 2.

The invention has been described in detail with particular reference to preferred embodiments thereof, but it will be understood that variations and modifications can be effected within the spirit and scope of the invention.

I claim:

1. For use with a portable printer having a housing with a print media ingress in its lower rear wall and a print media egress in its top wall, a print media cartridge comprising:

(a) a cartridge housing including: (i) an elongated member of generally U-shaped cross-section having a top wall portion and a bottom wall portion with a planar bottom surface and (ii) two end wall portions closing the ends of said elongated member;

(b) a cartridge door of size and shape corresponding to the open side of said elongated member;

(c) means for hingedly coupling said cartridge door to the lip of said bottom wall portion of said elongated member;

(d) means for latching said cartridge door in a closed position to said cartridge housing; and (e) a roll of print media supported within said cartridge housing in an orientation such that the roll ends face respective end wall portions and that its lead edge unwinds adjacent said bottom wall portion;

said cartridge door being a planar element constructed to rest, in an open condition, on a flat surface coplanar with said bottom wall portion and be held under the printer housing so that the printer weight retains an operative cartridge position vis-a-vis said printer.

2. The invention defined in claim 1 wherein said cartridge door has approximately the same height and width as said printer rear wall so that said roll can be easily aligned to the print media egress of said printer.

3. The invention defined in claim 1 wherein the latching means is on the lip of said top wall member and is constructed to interfit with the top wall surface of said printer to prevent media re-feed into the printer ingress.

4. The invention defined in claim 1 wherein said cartridge has retainer means for axially locating said media roll along the length of said U-shaped member.

5. The invention defined in claim 4 wherein said retainer means defines a print head storage compartment within said cartridge, adjacent said media roll.

* * * * *